US005704725A

United States Patent [19]

Horing

[11] Patent Number: 5,704,725

[45] Date of Patent: Jan. 6, 1998

[54] LOCATING STRUCTURE FOR LUGGAGE PULL ROD

[76] Inventor: Ruen-Liann Horing, No. 4, Lane 154, Chang-Shun St.., Wan-An Li, Changhua City, Taiwan

[21] Appl. No.: 725,473

[22] Filed: Oct. 4, 1996

[51] Int. Cl.[6] ..... B25G 1/04

[52] U.S. Cl. ..... 403/109; 403/377; 280/655; 280/47.315; 16/115; 190/18 A

[58] Field of Search ..... 403/109, 104, 403/377, 105, 106, 107, 108, 378, 83, 325, 321, 322; 280/655, 655.1, 47.315, 47.371; 16/115; 24/116; 190/18 A, 115

[56] References Cited

U.S. PATENT DOCUMENTS

| | | | |
|---|---|---|---|
| 3,463,436 | 8/1969 | Foster, Jr. | 24/116 A |
| 5,367,743 | 11/1994 | Chang | 403/109 X |
| 5,371,923 | 12/1994 | Chang | 403/109 X |
| 5,500,981 | 3/1996 | Ho | 280/655 X |
| 5,513,873 | 5/1996 | Chen | 280/655 |
| 5,515,576 | 5/1996 | Tsai | 16/115 |
| 5,530,990 | 7/1996 | Chen | 280/655.1 X |
| 5,581,846 | 12/1996 | Wang | 16/115 |
| 5,581,847 | 12/1996 | Hsien | 280/655.1 X |

*Primary Examiner*—Harry C. Kim
*Attorney, Agent, or Firm*—Bacon & Thomas

[57] ABSTRACT

A locating structure for luggage pull rod, including a rectangular outer tube, a rectangular inner tube, a locating cord, an engaging body, a small spring, a large spring, a control linking lever, two opposite cover bodies and two sealing caps. The outer tube is integrally made and two ends of top face of the outer tube are respectively formed with two notches. The top face of the inner tube is formed with an arch channel. The locating cord is disposed with multiple ball members at equal intervals. The engaging body is U-shaped. The top face of the engaging body is disposed with two concaves, while the bottom face thereof is formed with a central circular dent. One end of the control linking lever is connected with a control body, while the other end thereof is connected with a depression body. Two ends of the control body are disposed with two abutting legs. A rectangular hole is formed between the two abutting legs. Each of the two cover bodies has a small dimension insertion section. The inner side of each cover body is disposed with a first receiving chamber for the engaging body, a passage for the locating cord and a second receiving chamber for the control body.

1 Claim, 4 Drawing Sheets

LOCATING STRUCTURE FOR LUGGAGE PULL ROD

BACKGROUND OF THE INVENTION

The present invention relates to a locating structure for luggage pull rod, in which the outer tube is integrally made and formed with two notches at two ends for locating the locating cord. The outer tube is manufactured and processed in an easy manner with shortened working time and lowered cost.

FIG. 1 shows a conventional locating structure for luggage pull rod, which includes a U-shaped outer frame body 1, an elongated strip body 2, an inner tube body 3, an engaging body 4 and a small spring 5. The upper ends of two sides of the outer frame body 1 are respectively formed with two inward bent insertion edges 6. The strip body 2 is punched with multiple concaves 7 on bottom face. The opposite side of each concave 7 is formed with a corresponding convex 7a. In addition, two sides of the strip body 2 are respectively disposed with two insertion channels 8. One end of the inner tube body 3 is disposed with a receiving chamber 9 for the engaging body. A control means 10 is disposed in the inner tube body 3. The engaging body 4 is U-shaped and disposed with two convexes 11 on top face.

Referring to FIG. 2, when assembled, the insertion edges 6 of the outer frame body 1 are fitted into the insertion channels 8 of the strip body 2 and then secured thereto by punching. The small spring 5 is fitted in the bottom side of the engaging body 4. Then the engaging body 4 as well as the small spring 5 are fitted into the receiving chamber 9 of the inner tube 3. In normal state, the engaging body is stopped by the stopper legs of the control means 10 in the inner tube body 3, whereby the two convexes 11 thereof cannot extend into the receiving chamber 9 of the inner tube body 3. When the end of the control means is depressed inward, the stopper legs are disengaged from the lower side of the engaging body 4 so that the engaging body 4 can compress the small spring 5 to totally extend into the receiving chamber 9 of the inner tube body 3. The inner tube body 3 is fitted into the outer frame body 1, making the convexes 11 of the engaging body 4 engaged in the concaves 7 of the strip body 2 by means of the resilient extension of the small spring 5. Then the end of the control means 10 is released to make the stopper legs thereof again positioned under the engaging body 4 to stop the convexes 11 thereof from extending into the receiving chamber 9 of the inner tube body 3 so as to locate the inner tube body 3. Then two cap members 12 are plugged into two ends of the outer frame body 1.

When it is desired to telescope the inner tube body 3, the control means 10 is depressed inward to make the stopper legs disengaged from the lower side of the engaging body 4. At this time, the inner tube body 3 can be pulled upward or pushed downward. The engaging body 4 compresses the small spring 5 to totally extend into the receiving chamber 9 of the inner tube body 3. At this time, the convexes 11 of the engaging body 4 are disengaged from the concaves 7 of the strip body 2, permitting the inner tube body 3 to be pulled upward or pushed downward. After the inner tube body 3 is adjusted to a desired position, the end of the control means is released to make the stopper legs again positioned under the engaging body 4 to stop the convexes 11 of the engaging body 4 from extending into the receiving chamber 9 of the inner tube body 3 for locating the inner tube body.

According to the above arrangement, several shortcomings exist as follows:

The upper ends of two sides of the outer frame body 1 are upward bent to form the insertion edges. The bottom face of the strip body 2 is punched with multiple concaves 7. In addition, two sides of the strip body 2 are respectively formed with two insertion channels 8. The insertion edges 6 of the outer frame body 1 are fitted into the insertion channels 8 of the strip body 2 and secured thereto by punching so as to form the outer tube body. It is troublesome and laborious to perform such procedures. Also, the working time for these processing operation is increased so that the manufacturing cost is relatively high.

SUMMARY OF THE INVENTION

It is therefore a primary object of the present invention to provide a locating structure for luggage pull rod, including an outer tube integrally made and formed with two notches at two ends for locating a commercially available locating cord. In cooperation with an engaging body, the inner tube can be adjusted and located in a smooth and easy manner. The outer tube is manufactured and processed in an easy manner with shortened working time and lowered cost.

The present invention can be best understood through the following description and accompanying drawings, wherein:

DETAILED DESCRIPTION OF THE PREFERRED EMBODIMENT

Figure 3:
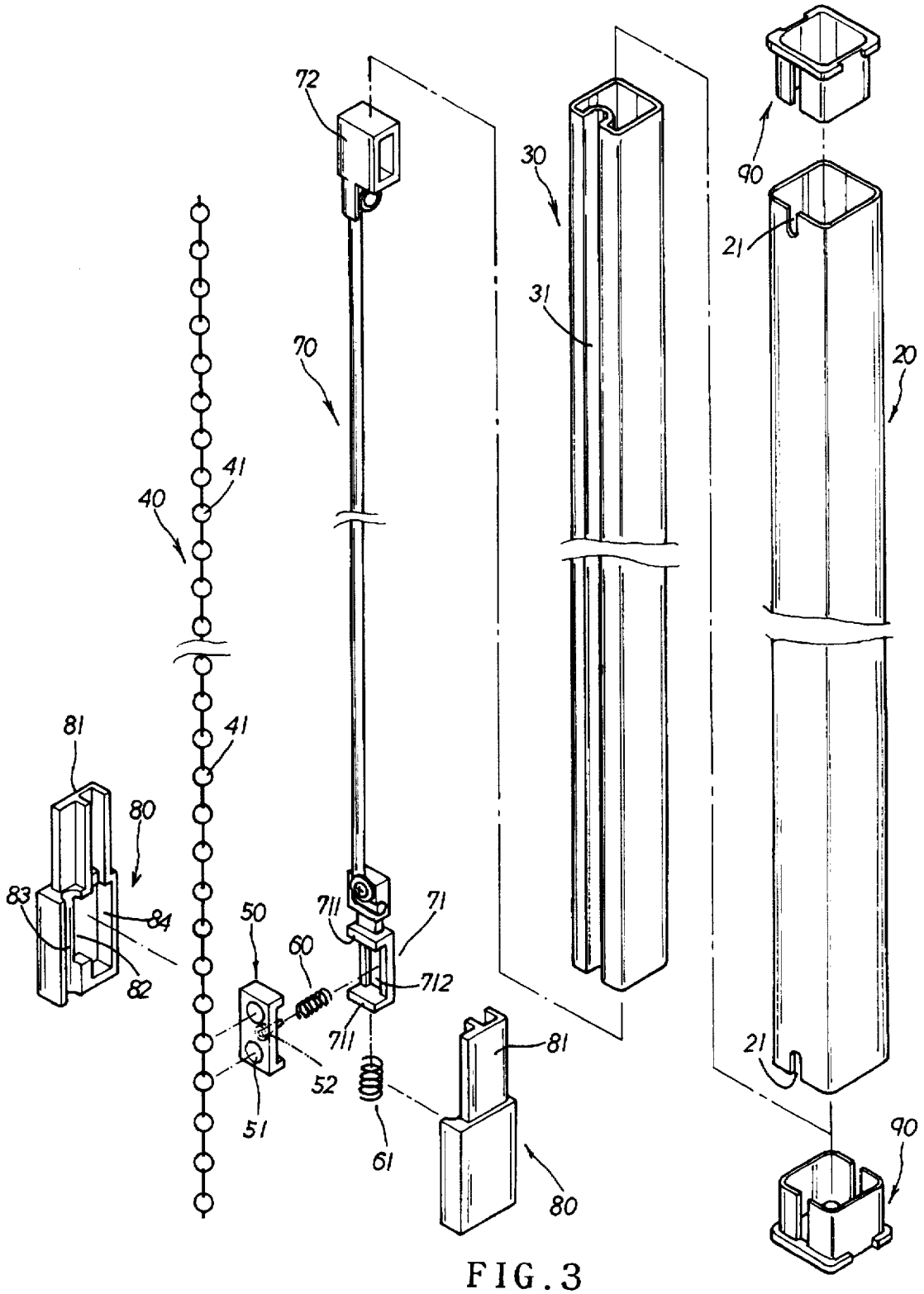
FIG. 3 is a perspective exploded view of the present invention.

Please refer to FIG. 3. The present invention includes a rectangular outer tube 20, a rectangular inner tube 30, a locating cord 40, an engaging body 50, a small spring 60, a large spring 61, a control linking lever 70, two opposite cover bodies 80 and two sealing caps 90. Two ends of top face of the outer tube 20 are respectively formed with two notches 21. The top face of the inner tube 30 is formed with an arch channel 31. The locating cord 40 is disposed with multiple ball members 41 at equal intervals. The engaging body 50 is U-shaped. The top face of the engaging body 50 is disposed with two concaves 51, while the bottom face thereof is formed with a central circular dent 52. One end of the control linking lever 70 is connected with a control body 71, while the other end thereof is connected with a depression body 72. Two ends of the control body 71 are disposed with two abutting legs 711. A rectangular hole 712 is formed between the two abutting legs 711. Each of the two cover bodies 80 has a small dimension insertion section 81. The inner side of each cover body 80 is disposed with a first receiving chamber 82 for the engaging body, a passage 83 for the locating cord and a second receiving chamber 84 for the control body.

Figure 1:
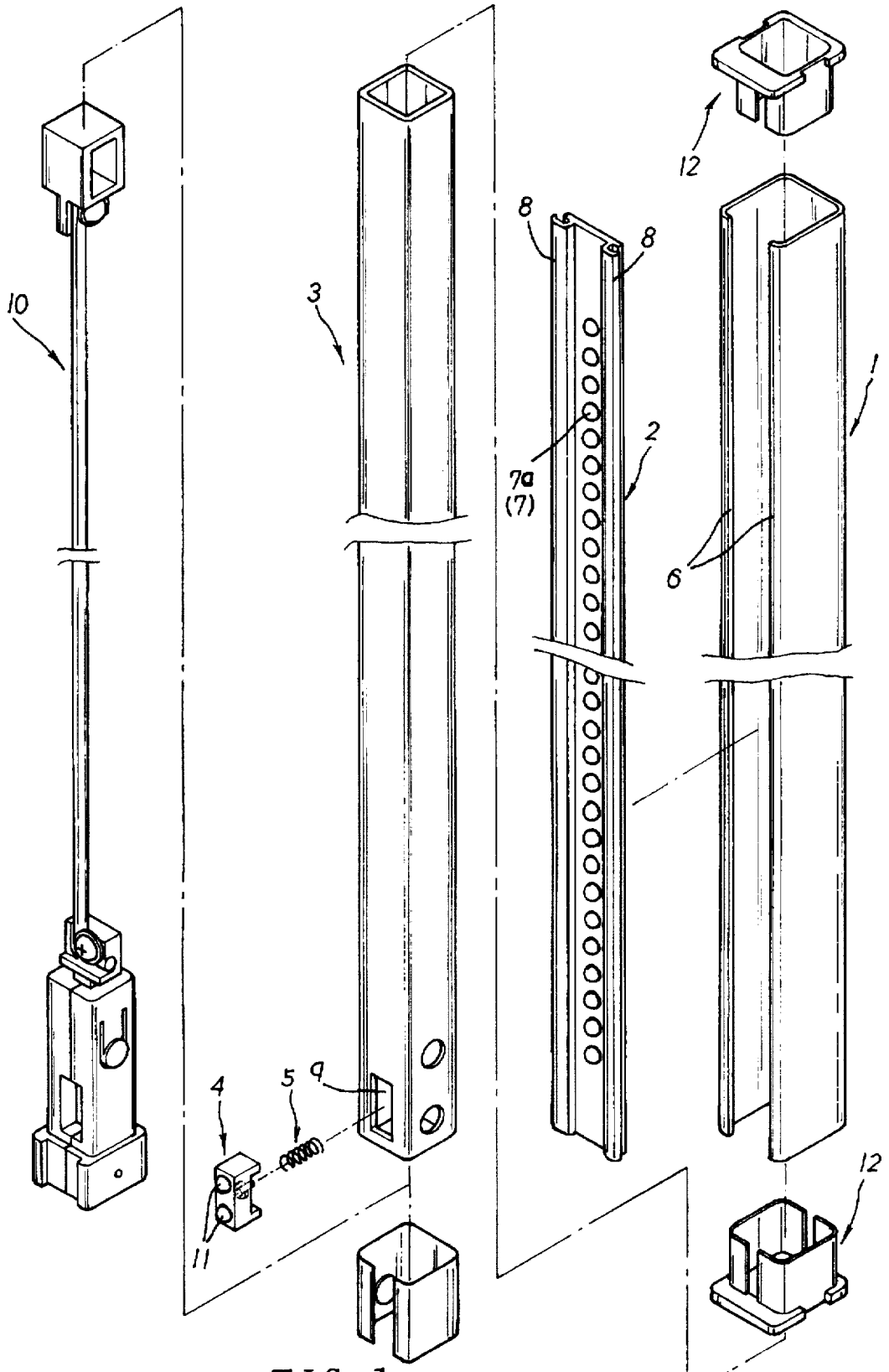
FIG. 1 PRIOR ART
FIG. 1 is a perspective exploded view of a conventional locating structure for luggage pull rod.
Figure 2:
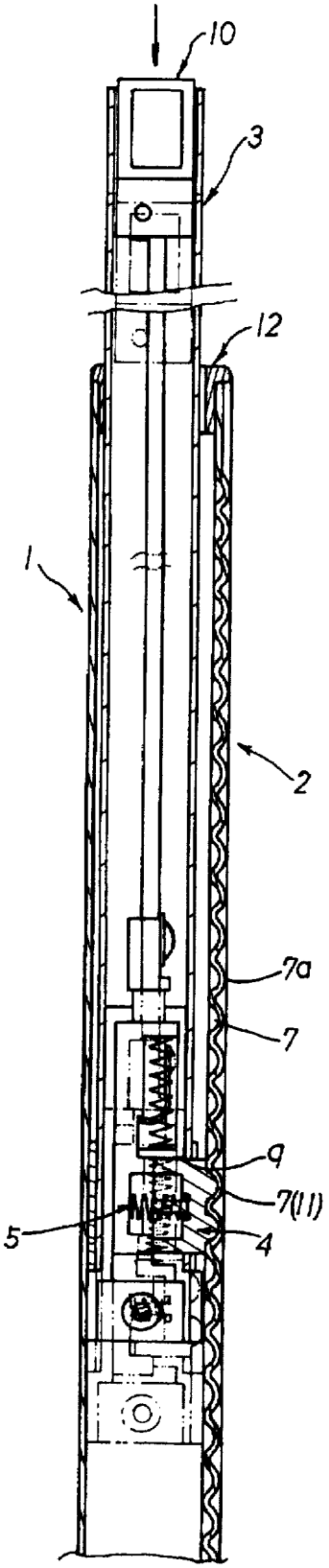
FIG. 2 PRIOR ART
FIG. 2 is a sectional assembled of the conventional locating structure of FIG. 1, showing the operation thereof.
Figure 4:
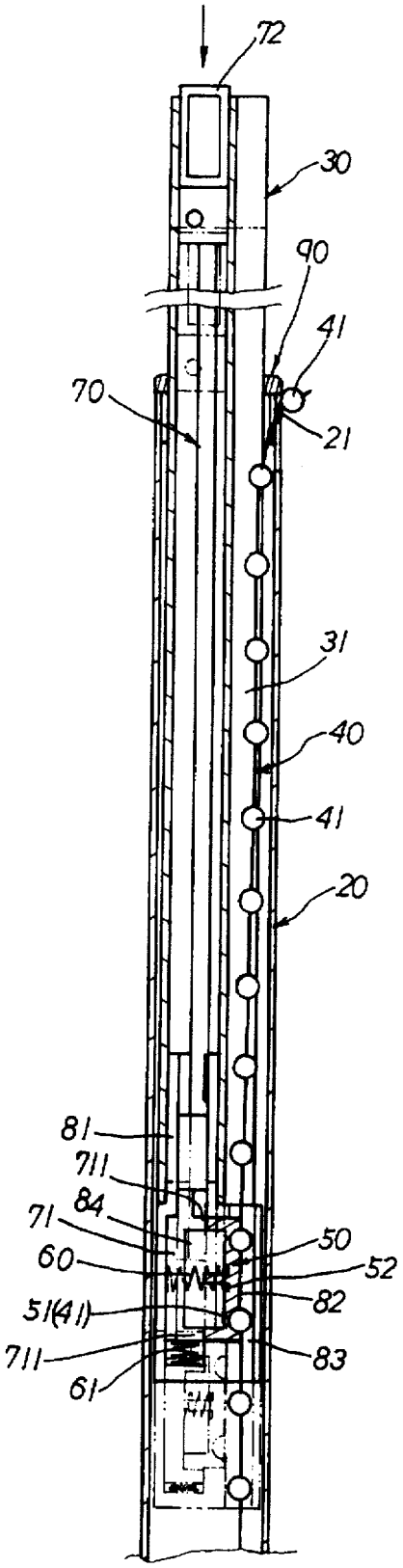
FIG. 4 is a sectional assembled view of the present invention, showing the operation thereof.

Referring to FIG. 4, when assembled, the control body 71 connected with one end of the control linking lever 70 is fitted in the second receiving chamber 84 of one cover body 80. One end of the large spring 61 abuts against the end face of the control body of the linking lever 70, while the other end thereof abuts against the wall of the lower end of the second receiving chamber 84 of the cover body 80. Then the small spring 60 is fitted in the circular dent 52 of the engaging body 50. The engaging body 50 together with the small spring 60 is fitted in the first receiving chamber 82 of the cover body 80 with the small spring 60 passing through the rectangular hole 712 of the control body 71 to abut against the lateral wall of the second receiving chamber 84 of the cover body 80. In normal state, the engaging body 50 is stopped by the two abutting legs 711 of the control body 71 from downward compressing the small spring 60. In addition, one end section of the locating cord 40 is placed in the passage 83 of the cover body 80 with two ball members 41 of the end section engaged in the concaves 51 of the engaging body 50. Then the two opposite cover bodies 80 are associated with each other with their insertion sections 81 inserted into one end of the inner tube 30. Also, the locating cord 40 is received in the arch channel 31 of the inner tube 30 and the control linking lever 70 is fitted into the inner tube 30. Then the inner tube 30 as well as the two opposite cover bodies 80 are fitted into the outer tube 20 with two ends of the locating cord 40 inserted into the notches 21 of the outer tube 20. Then the two sealing caps 90 are respectively fitted into two ends of the outer tube 20 so as to restrict the locating cord 40 from displacing.

When it is desired to telescope the inner tube 30, the depression body 72 of the control linking lever 70 is depressed to compress the large spring 61. At this time, the two abutting legs 711 of the control body 71 are disengaged from the lower side of the engaging body 50, permitting the inner tube 30 to be pulled upward or pushed downward. The engaging body 50 compresses the small spring 60 to make the concaves 51 of the engaging body 50 disengaged from the ball members 41 of the locating cord 40, whereby the inner tube 30 can be smoothly pulled upward or pushed downward. When the inner tube 30 is moved to a proper position, the two concaves 51 of the engaging body 50 are engaged with two proper ball members of the locating cord 40. Then the depression body 72 of the control linking lever 70 is released to make the two abutting legs 711 of the control body 71 again positioned under the engaging body 50 to stop the engaging body 50 from downward compressing the small spring 60 so as to locate the inner tube 30.

Figure 5:
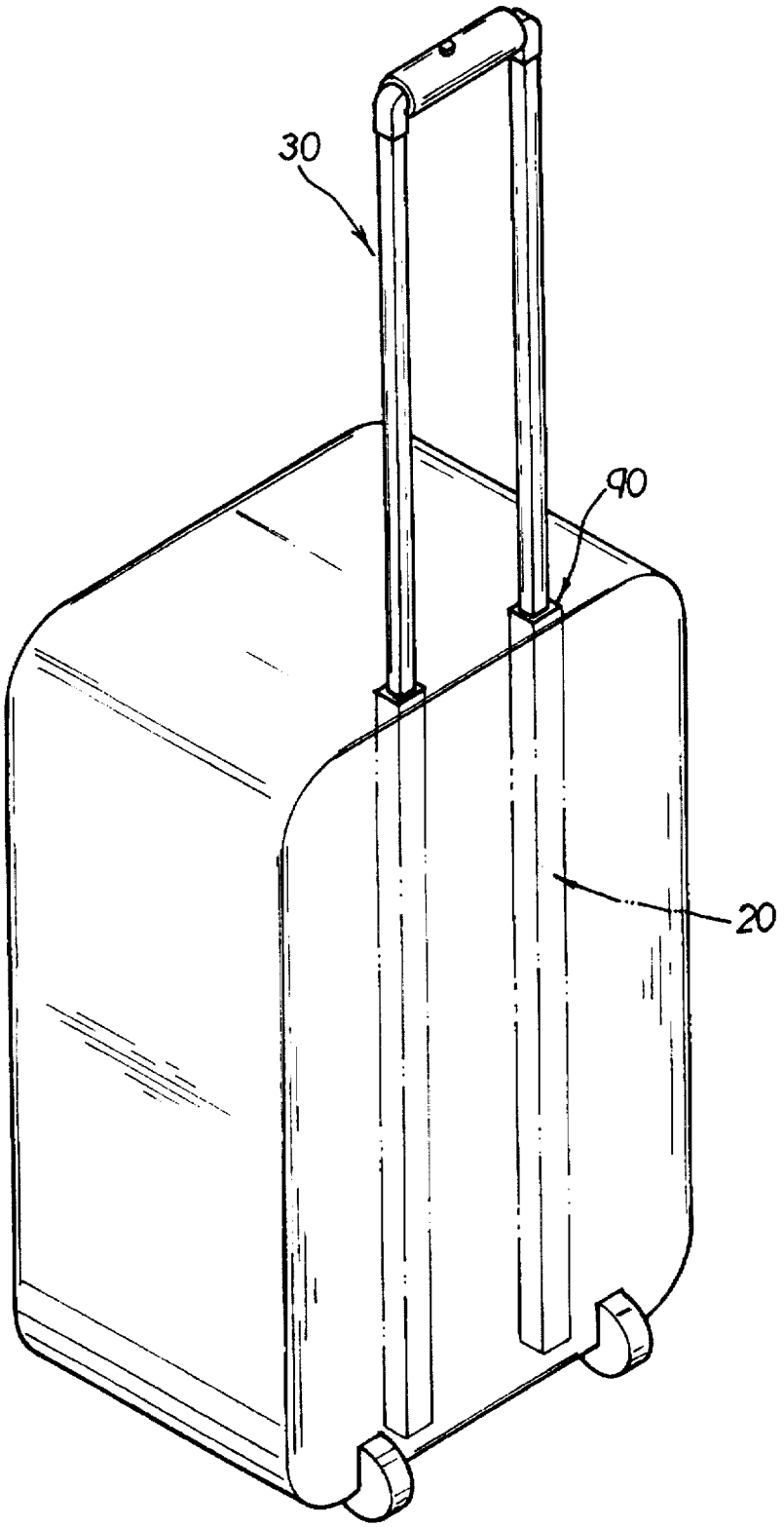
FIG. 5 shows the application of the present invention.

FIG. 5 shows the application of the present invention, in which the outer tubes 20 are disposed in the bottom side of the luggage. A handle is connected between the top ends of the two inner tubes 30.

According to the above arrangement, the outer tube is integrally made rather than made of a U-shaped frame body and an engaging strip body connected therewith and punched with multiple concaves on bottom face as conventional measure. Therefore, the outer tube is manufactured and processed in an easy manner with shortened working time and lowered cost.

The above embodiment is only an example of the present invention and the scope of the present invention should not be limited to the example. Any modification or variation derived from the example should fall within the scope of the present invention.

What is claimed is:

1. A locating structure for luggage pull rod, comprising a rectangular outer tube, a rectangular inner tube, a locating cord, an engaging body, a small spring, a large spring, a control linking lever, two opposite cover bodies and two sealing caps, the locating cord being disposed with multiple ball members at equally spaced intervals, the engaging body being U-shaped, one end of the control linking lever being connected with a control body, while the other end thereof being connected with a depression body, two ends of the control body being disposed with two abutting legs, a rectangular hole being formed between the two abutting legs, said locating structure being characterized in that:

two ends of top face of the outer tube are respectively formed with two notches;

a top face of the inner tube is formed with an arch channel;

a top face of the engaging body is disposed with two concaves, while a bottom face thereof is formed with a central circular dent;

each of the two cover bodies has a small dimension insertion section, an inner side of each cover body being disposed with a first receiving chamber for the engaging body, a passage for the locating cord and a second receiving chamber for the control body; and when assembled, the small spring is fitted in the circular dent of the engaging body and the engaging body together with the small spring is fitted in the first receiving chamber of one of the cover bodies with the small spring passing through the rectangular hole of the control body to abut against a lateral wall of the second receiving chamber of the cover body and the large spring is fitted between an end face of the control body and a lower end of the second receiving chamber of the cover body, in normal state, the engaging body being slopped by the two abutting legs of the control body from compressing the small spring, one end section of the locating cord being placed in the passage of the cover body with two of the ball members of the end section engaged in the concaves of the engaging body, then the two opposite cover bodies being associated with each other with their insertion sections inserted into one end of the inner tube, the locating cord being received in the arch channel of the inner tube and the control linking lever being fitted into the inner tube, then the inner tube as well as the two opposite cover bodies being fitted into the outer tube with two ends of the locating cord inserted into the notches of the outer tube, then the two sealing caps being respectively fitted into the two ends of the outer tube so as to restrict the locating cord from displacing.

* * * * *